US005893615A

United States Patent [19]

Hendricks

[11] Patent Number: 5,893,615

[45] Date of Patent: Apr. 13, 1999

[54] NEWSPAPER VENDING DEVICE

[75] Inventor: Robert Hendricks, Youngstown, Ohio

[73] Assignee: Steel City Corporation, Youngstown, Ohio

[21] Appl. No.: 09/054,914

[22] Filed: Apr. 3, 1998

[51] Int. Cl.[6] ..... A47F 1/00

[52] U.S. Cl. ..... 312/71; 312/306; 312/319.1

[58] Field of Search ..... 312/61, 71, 117, 312/306, 312, 319.1, 319.4, 350, 351, 60, 50; 221/279, 227; D20/6

[56] References Cited

U.S. PATENT DOCUMENTS 3,747,733 7/1973 Knickerbocker .
4,258,861 3/1981 Traill et al. ..... 221/227 X
4,312,461 1/1982 Godley, Sr. ..... 221/279 X
4,718,532 1/1988 Chalabian .
4,881,779 11/1989 Bubien .
5,232,077 8/1993 Nichols .

*Primary Examiner*—Peter M. Cuomo
*Assistant Examiner*—Karlena D. Schwing
*Attorney, Agent, or Firm*—Harpman & Harpman

[57] ABSTRACT

A self-contained mechanical vending device for displaying and dispensing newspapers by coin activated access. The vending device has a molded synthetic resin one-piece cabinet with an access door and release mechanism insert. A spring-activated newspaper storage elevator shelf and weight assembly stabilizes the device and presents the newspapers for selective removal through the access door.

5 Claims, 3 Drawing Sheets

NEWSPAPER VENDING DEVICE

BACKGROUND OF THE INVENTION

1. Technical Field

The device relates to vending machines for a newspaper and more particularly to coin access machines wherein a supply of newspapers are accessed by a coin activation door.

2. Description of Prior Art

Prior art devices are defined as typical newspaper vending machines in which a mechanism is provided to validate the inserted coins and release a door locking mechanism once a pre-determined coinage amount is reached allowing for access to a supply of newspapers within the vending device.

Such prior art devices have heretofore been fabricated out of metal having static newspaper storage areas in which a supply of newspapers were stacked. An access door typically had a newspaper receiving and viewing insert indicating the newspaper within and assuring that at least one newspaper was available upon door activation by the user to the storage compartment within.

Current prior art newspaper vending devices also have spring-urged storage elevators that hold a supply of newspapers within a lower storage compartment and correspondingly move the remaining supply of papers upwardly as they are selectively removed from the device, see for example U.S. Pat. No. 5,232,077.

In U.S. Pat. No. 5,232,077 a multi-vend newspaper rack having improved access to interior is illustrated and described as having a removable insert from a support base that is divided into multiple compartments for receiving newspapers and access mechanism.

SUMMARY OF THE INVENTION

A newspaper vending device that provides for selective coin activated access to a supply of newspapers within a storage and dispensing area. More specifically, the invention is directed to an improvement in the paper storage mechanism and an improved stabilization weight assembly within the vending device. A spring containment and guide assembly provides for improved non-jamming elevator tray action and a monolithic synthetic resin stabilization weight is integrally positioned within the storage and dispensing area while further providing support and mounting base for the spring containment and guide assembly.

DESCRIPTION OF THE PREFERRED EMBODIMENT

Figure 1:
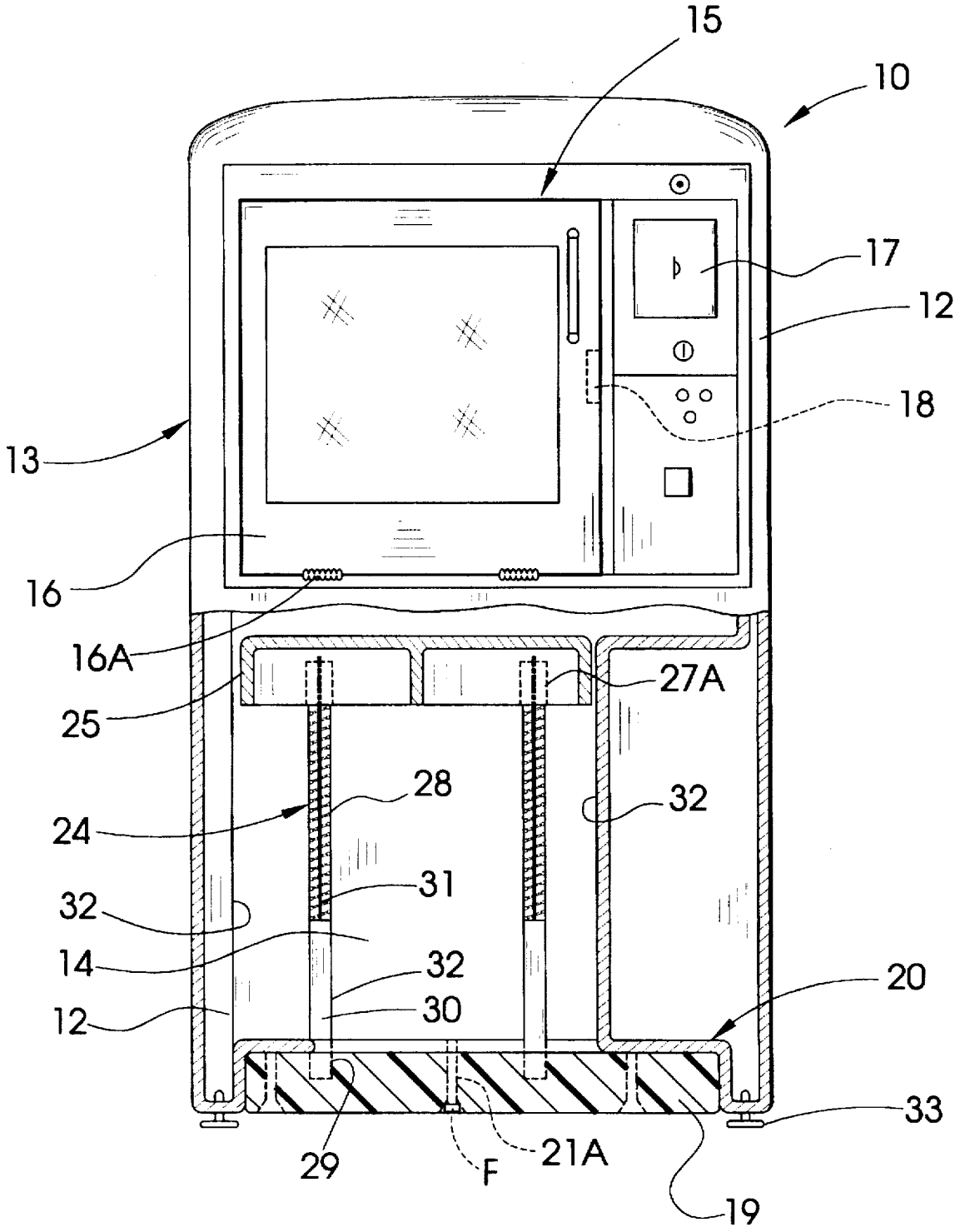
FIG. 1 is a front elevational view of the newspaper vending device of the invention.
Figure 2:
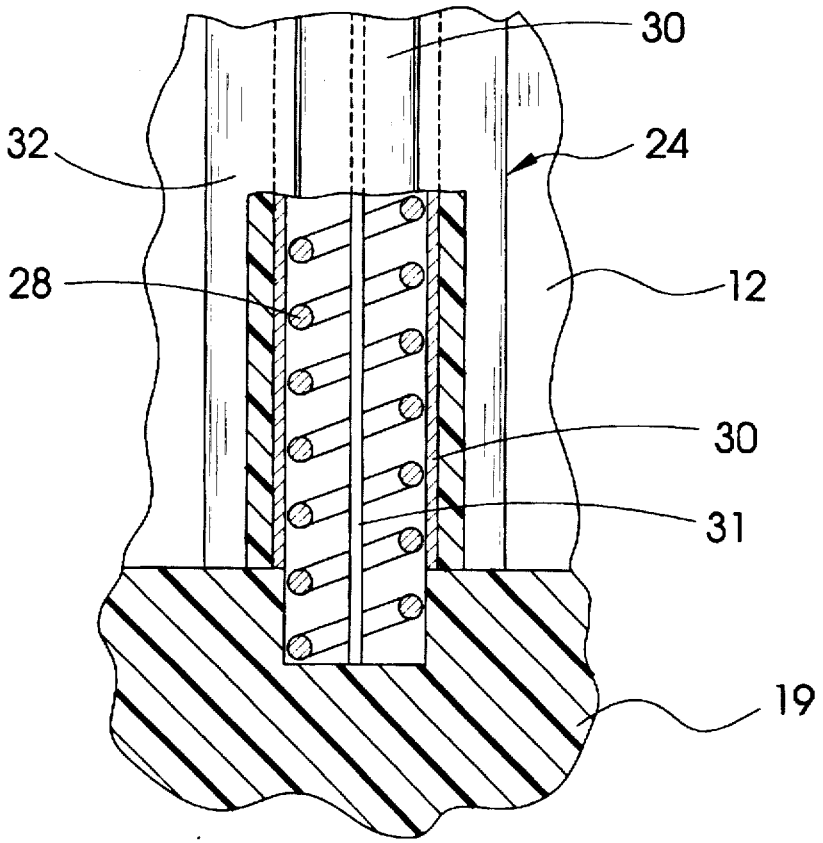
FIG. 2 is an enlarged partial cross-sectional view of the spring mounting and containment assembly.
Figure 3:
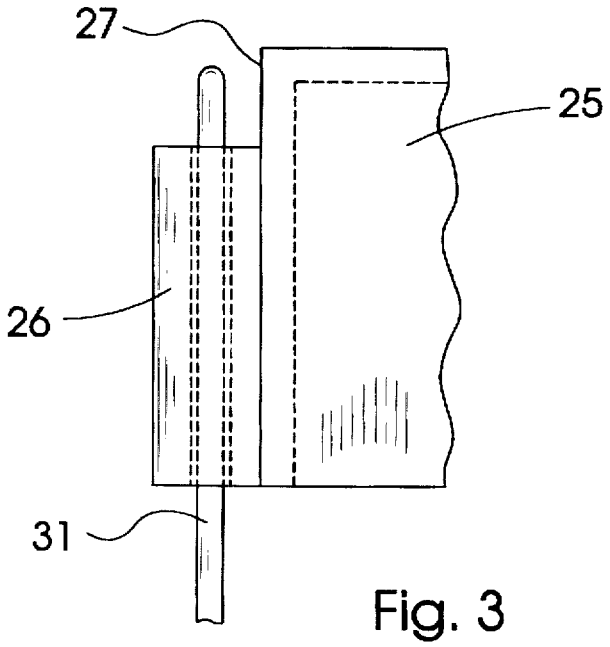
FIG. 3 is an enlarged partial side elevational view of the elevator shelf and guide rod support fittings.
Figure 4:
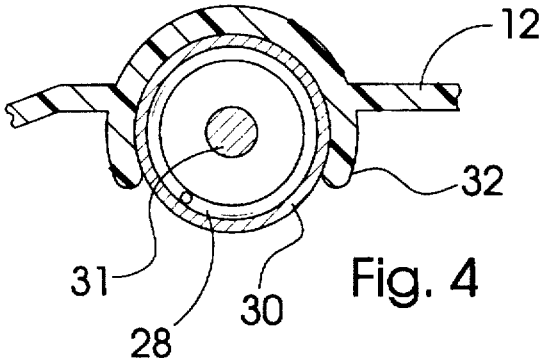
FIG. 4 is an enlarged cross-section of an elevator spring and support guide structure.

Referring to FIGS. 1 and 2 of the drawings, a newspaper vending device 10 of the invention can be seen having a molded double walled synthetic resin cabinet 12.

The cabinet 12 has a dispensing insert area 13 and a storage area 14. The insert area 13 receives a metal access and coin deposit assembly 15 shown for general illustration purposes in FIG. 1 of the drawings. A door 16 having hinges 16A of the access and coin deposit assembly 15 provides access upon opening to the paper storage area 14 which extends therebelow. The hinges 16A are of a non-corrosive metal for long life.

A coin receiving mechanism 17 is interconnected to a door latch 18 (shown in broken lines in FIG. 1 of the drawings) on the door 16 so that upon activation by the insertion of proper coinage the door latch 18 will be released allowing the door 16 to be open as will be well known and understood by those skilled in the art.

Figure 5:
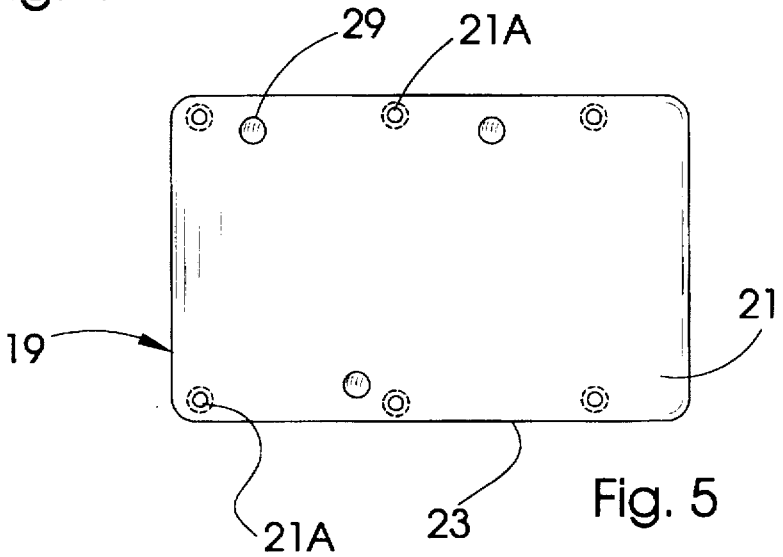
FIG. 5 is a top plan view of the synthetic stabilization weight.
Figure 6:
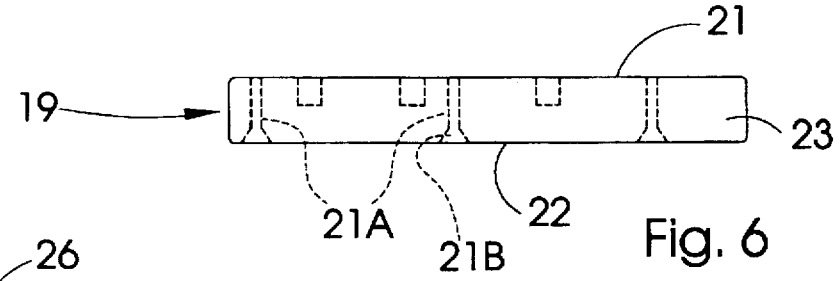
FIG. 6 is a side elevational view of the synthetic stabilization weight shown in FIG. 5.

The storage area 14 is defined by the hereinbefore described cabinet 12 and a stabilization weight 19 which is secured within an opening at the base of the cabinet at 20. The stabilization weight 19 of the invention, best seen in FIGS. 1, 5 and 6 is of a monolithic mass of molded synthetic resin having a high weight to mass ratio characterized by the molding process. The synthetic weight 19 is of a generally rectangular shape having a respective flat top 21 and bottom 22 and a continuous perimeter edge 23 thereabout. The synthetic weight 19 has a plurality of longitudinally spaced apertures at 21A therethrough which have an area of increased transverse dimension at 21B inwardly from the bottom 22 that provide respective registration of a plurality of corresponding fixation fasteners F which extend through the synthetic weight 19 and outwardly from the top surface 21 for registerable engagement with portions of the cabinet 12 adjacent the bottom opening at 20.

Figure 7:
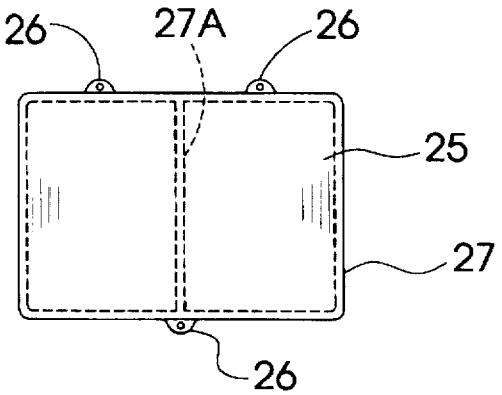
FIG. 7 is a top plan view of the elevator shelf and guide rod engagement lugs extending therefrom.

Referring now to FIGS. 1, 2 and 7 of the drawings, a paper elevator assembly 24 can be seen including a paper support and transportation tray 25 having a rectangular shape with a plurality of outstanding apertured mounting lugs 26 extending therefrom on oppositely disposed perimeter edges 27 of the transportation tray 25.

The tray 25 is supported by a plurality of springs 28 that are registerable within corresponding recess areas at 29 which are formed in the top 21 of the stabilization weight 19 as best seen in FIGS. 6 and 7 of the drawings.

Each of the springs 28 have a exterior guide sleeve 30 on a portion thereof and an interior guide rod 31 extending therethrough that extends from the synthetic weight 19 to the respective apertured lugs 26 on the transport tray 25. The assembled support configuration of the spring, sleeve and rods are in turn registerable within the respective guide channels 32 formed in the interior walls of the cabinet 12 as best seen in FIG. 2 of the drawings.

It will be evident from the foregoing description that the transportation tray 25 will move vertically on the guide rods 31 under the weight of stacked newspapers (not shown) thereon with the springs 28 correspondingly compressing within the guide sleeves 30 which, as noted, will prevent transverse distortion of the springs by confining them within the sleeves.

The cabinet 12 has interior guide surfaces 32 that define the travel path of the transportation tray 25 within the paper storage area 14 of the cabinet 12 as hereinbefore described.

Referring now to FIG. 2 of the drawings, it will be seen that the inter-engagement of the springs 28 and the hereinbefore described rods 31 within the recessed mounting areas at 29 with the corresponding guide sleeves 30 travels freely on the springs 28 within the guide channels 32. This arrangement provides multiple point resilient support triad for the transportation tray 25. The stabilization weight 19 becomes an integral part of the cabinet 12 and is the mounting base for the transportation tray 25 support assembly as hereinbefore described. The synthetic weight 19 in this example having a mass weight of 26 pounds which acts primarily as a stabilization factor for the vending machine 10 of the invention.

Typically, the transportation tray 25, seen in FIGS. 1 and 7 of the drawings is molded of synthetic resin material in a shell form having a transverse rib 27A and as assembled will be continuously height adjustable as newspapers (not shown) are added or removed during use as will be well understood and evident to those skilled in the art.

The support cabinet 12 is height adjustable by a plurality of feet 33 threadably extend from the base of the cabinet 12 so that they may be incrementally adjusted by rotation in relation to the base service thus providing a leveling adjustment to the cabinet 12.

Thus it will be seen that a new and improved newspaper vending machine has been illustrated and described and it will be apparent to those skilled in the art that various changes and modifications may be made therein without departing from the spirit of the invention.

Therefore I claim:

1. A newspaper vending machine comprising;

a synthetic resin cabinet having a top, front and sidewalls and bottom, a dispensing insert area and a storage area within said cabinet, an access means and money accepting means within said dispensing insert area, a paper transportation elevator and a monolithic synthetic weight within said storage area, said paper transport elevator comprises; a transportation tray, having a plurality of apertured lugs, a resilient engagement and guide assembly comprising; a coil spring, a guide rod extending through said spring, a guide sleeve movably positioned on a portion of said coil spring, guide channels in said cabinet sidewalls, said spring and guide sleeve movably positioned on a portion thereof positioned partially within said guide channels, means for securing said transportation tray to said resilient engagement and guide assembly.

2. The newspaper vending machine set forth in claim 1 wherein said synthetic resin cabinet has double exterior walls.

3. The newspaper vending machine set forth in claim 1 wherein said access means comprises; a hinged door.

4. The newspaper vending machine set forth in claim 1 wherein said synthetic weight has recessed mounting areas therein for said resilient engagement and guide assembly.

5. The newspaper vending machine set forth in claim 1 wherein said guide rod is of a metallic non-corrosive material.

* * * * *